US006756897B2

(12) United States Patent
Mizukami et al.

(10) Patent No.: US 6,756,897 B2
(45) Date of Patent: Jun. 29, 2004

(54) FIRE RECEIVER

(75) Inventors: Akira Mizukami, Tokyo (JP); Tsutomu Yamaura, Tokyo (JP)

(73) Assignee: Nohmi Bosai Ltd., Tokyo (JP)

( * ) Notice: Subject to any disclaimer, the term of this patent is extended or adjusted under 35 U.S.C. 154(b) by 76 days.

(21) Appl. No.: 10/140,821

(22) Filed: May 9, 2002

(65) Prior Publication Data

US 2003/0058122 A1 Mar. 27, 2003

(30) Foreign Application Priority Data

Sep. 27, 2001 (JP) ..... 2001-296083
Oct. 24, 2001 (JP) ..... 2001-326917

(51) Int. Cl.[7] ..... G08B 25/00

(52) U.S. Cl. ..... 340/525; 340/815.55; 340/815.73; 40/575

(58) Field of Search ..... 340/525, 815.49, 340/815.5, 815.53, 815.55, 815.73; 40/568, 569, 570, 575, 576, 577

(56) References Cited

U.S. PATENT DOCUMENTS 5,057,818 A 10/1991 Tennefoss ..... 340/525

FOREIGN PATENT DOCUMENTS

EP 0 915 444 5/1999
JP 10123988 A * 5/1998 ..... G08B/5/36
JP 410326389 A * 12/1998 ..... G08B/17/00

* cited by examiner

*Primary Examiner*—Toan N. Pham
(74) *Attorney, Agent, or Firm*—Wenderoth, Lind & Ponack, L.L.P.

(57) ABSTRACT

A fire receiver for use in a building is divided into sections for each of which window indication is made by using a corresponding window. The fire receiver includes: a base having a frame for window indication; a rectangular window sheet to which the names of the sections are written and which is fitted into the frame of the base; and a substantially transparent protective sheet which is substantially of the same configuration as the window sheet and arranged in front thereof. The window sheet has at its longitudinal ends rectangular engagement members to be engaged with engagement grooves of the frame and at its center a central rectangular engagement member to be engaged with a central engagement groove of the frame.

13 Claims, 17 Drawing Sheets

FIRE RECEIVER

BACKGROUND OF THE INVENTION

1. Field of the Invention

The present invention relates to a fire receiver for indicating a condition of a building, an occurrence of fire or a gas leakage, etc.

2. Description of the Related Art

A conventional fire receiver used in a fire alarm equipment, when fire sensors provided at various places of the building detect fire, indicates on a display unit the corresponding section of the building that is on fire and sounds an alarm to thereby provide visible and audible warnings of the fire. There are two main systems for indicating a section on fire: a fire section indicating system in which a number or a character indicating a section on fire is given by using a so-called seven segment display or a liquid crystal display (LCD), and a section window indicating system in which all the windows corresponding to monitoring sections set in the building are formed in a single or a plurality of display units and in which an indicating lamp that indicates an action such as fire is provided for each window.

In the section window indicating system, all the monitoring sections set in the building have to be formed as windows, each window indicating the name of the corresponding section, etc. Thus, usually there is provided a window sheet to be fitted into the window frame and the window sheet in which the information is completed is held under a transparent protective sheet. If the use of the section is changed to cause a change in its name, etc., it is only necessary to replace the window sheet fitted into the window frame.

The display unit of such a section window indicating system is used not only in a fire receiver, but also in a fire annunciator that indicates the position of fire. Apart from this, it is used in various display units for indicating, e.g., a floor on which a fire extinguishing equipment with sprinklers is working, or a monitoring section in which a security system is operating.

Next, a casing of a conventional fire receiver will be described.

FIGS. 16 and 17 are diagrams illustrating an example of a conventional fire receiver. FIG. 16 is a front view showing a panel surface, and FIG. 17 is a front view with its door open.

Connected to the fire receiver is a line (not shown) equipped with a terminal apparatus such as a fire sensor. As shown in FIG. 17, there are provided in a box-like main body 3 a main operating portion 10 connected to the line and adapted to perform various settings on the terminal apparatus, etc., and eight display units 21*a* through 21*e* and 22*f* through 22*h* connected to the main operating portion 10 and adapted to indicate the conditions, etc. of the terminal apparatuses. Further, provided in a door 4 forming the main body 3 are a main opening 5 and openings 41*a* through 41*e* and 42*f* through 42*h* in correspondence with an indicating portion 10A of the main operating portion 10 and indicating portions 31*a* through 31*e* and 32*f* through 32*h* of the display units 21*a* through 21*e* and 22*f* through 22*h*. Mounted to the door 4 are a main transparent protective plate 7 and transparent protective plates 51*a* through 51*e* and 52*f* through 52*h* so as to cover the main opening 5 and the openings 41*a* through 41*e* and 42*f* through 42*h*.

With this structure, the outer side of the fire receiver is covered with a casing 40 formed by the box-like main body 3 equipped with the door 4 and the main transparent protective plate 7 and the transparent protective plates 51*a* through 51*e* and 52*f* through 52*h* mounted to the door 4, whereby intrusion of dust or the like into the interior is prevented. Normally, the fire receiver is locked with the door 4 closed so that the main operating portion 10, etc. may not be operated, and the indication on the main operating portion 10 and the display units 21*a* through 21*e* and 22*f* through 22*h* can be visually checked from outside the casing 40 through the main transparent protective plate 7 and the transparent protective plates 51*a* through 51*e* and 52*f* through 52*h*.

The above-mentioned conventional fire receiver, however, involves the following problems. In the display unit of the section window indicating system, it is desirable for the window sheet, to which the section name, etc. are written, to be easily replaced and to be of a simple structure in which it is easily detachable.

Further, as shown in FIG. 17, the casing 40 allows, for example, provision of five display units on the right-hand side and three display units on the left-hand side, i.e., eight display units in total. However, the number of display units required varies depending on the building in which the system is installed. Thus, for the casing of a conventional fire receiver, a number of kinds of doors with different numbers of openings are prepared, and an arbitrary door corresponding to the requisite display units for the building is used. This arrangement is adopted to enable the person on guard monitoring the fire receiver or the like installed in a building or the like to check the indication of the display units at a glance. If there is an opening corresponding to a display unit not provided in the casing, and the interior of the casing can be observed therethrough, the checking operation becomes the more complicated. Further, for a better outward appearance, it is desirable to eliminate an opening corresponding to a display unit not provided in the casing so that the interior of the casing cannot be observed through such an opening. This leads to an increase in parts cost and makes the stock control in the plant and the shipping difficult to perform. Further, when the number of display units is to be increased or decreased after installation, the door has to be replaced.

SUMMARY OF THE INVENTION

The present invention has been made in view of the above, and an object of the present invention is therefore to simplify the structure of a section window of a display unit for use in the section indicating system to thereby facilitate the replacement of the window sheet.

Another object of the present invention is to provide a casing for use in a fire receiver or the like in which display units provided in the casing can be visually checked from outside, in which one type of door can be applied to buildings requiring different numbers of display units.

According to a first aspect of the present invention, there is provided a fire receiver in which a building is divided into sections for each of which window indication is made by using a corresponding window. The fire receiver comprises: a base having a frame for window indication; a rectangular window sheet to which the names of the sections are written and which is fitted into the frame of the base; and a rectangular substantially transparent protective sheet which is substantially of the same configuration as the window sheet and arranged in front of it and has at its longitudinal ends engagement members to be engaged with engagement grooves of the frame and at its center a central engagement member to be engaged with a central engagement groove of the frame.

Preferably, in the fire receiver, the window sheet corresponds to a plurality of sections and consists of a rectangular sheet longitudinally divided into a plurality of portions to which the names of the sections can be written. In addition, preferably, indicating lamps are provided in correspondence with the sections.

According to a second aspect of the present invention, there is provided a fire receiver comprising: a main body in which a plurality of display units are provided; a door mounted to the main body so as to be capable of opening and closing, a plurality of openings being formed in advance in the door in correspondence with the positions where the display units can be provided in the main body; transparent protective means mounted to the door and adapted to cover the plurality of openings; and opaque covering means attached to positions corresponding to the plurality of openings on the transparent protective means and separable from each opening.

Preferably, in the fire receiver, the opaque covering means consists of a plurality of opaque seals separable from the openings corresponding to the positions where the display units are actually provided in the main body. In addition, preferably, the transparent protective means comprises at least one transparent protective plate, and the one transparent protective plate collectively covers a plurality of the openings provided in a row in the door.

According to another second aspect of the present invention, there is provided a fire receiver comprising: a main body in which a plurality of display units are provided; a door mounted to the main body so as to be capable of opening and closing, a plurality of openings being formed in advance in the door in correspondence with the positions where the display units can be provided in the main body; and protective means consisting of a plurality of plates selected from a plurality of transparent protective plates and a plurality of opaque protective plates and mounted to the door to cover the plurality of openings.

According to another second aspect of the present invention, there is provided a fire receiver comprising: a main body in which a plurality of display units are provided; a door mounted to the main body so as to be capable of opening and closing, a plurality of knock-out portions capable of forming a plurality of openings being provided in the door in correspondence with the positions where the display units can be provided in the main body; and transparent protective means for covering at least one of the openings formed in the door.

Preferably, in the fire receiver, the opaque covering means and the opaque protective plates are substantially the same color as the door. In addition, preferably, the display units respectively make window indication using windows corresponding to sections into which a building is divided and the window consists of a base having a frame for window indication and a rectangular window sheet to which the names of the sections are written and which is fitted into a frame of the base and a rectangular substantially transparent protective sheet which is substantially of the same configuration as the window sheet and arranged in front of it and has at its longitudinal ends engagement members to be engaged with engagement grooves of the frame and at its center a central rectangular engagement member to be engaged with a central engagement groove of the frame.

DESCRIPTION OF THE PREFERRED EMBODIMENTS

Figure 1:
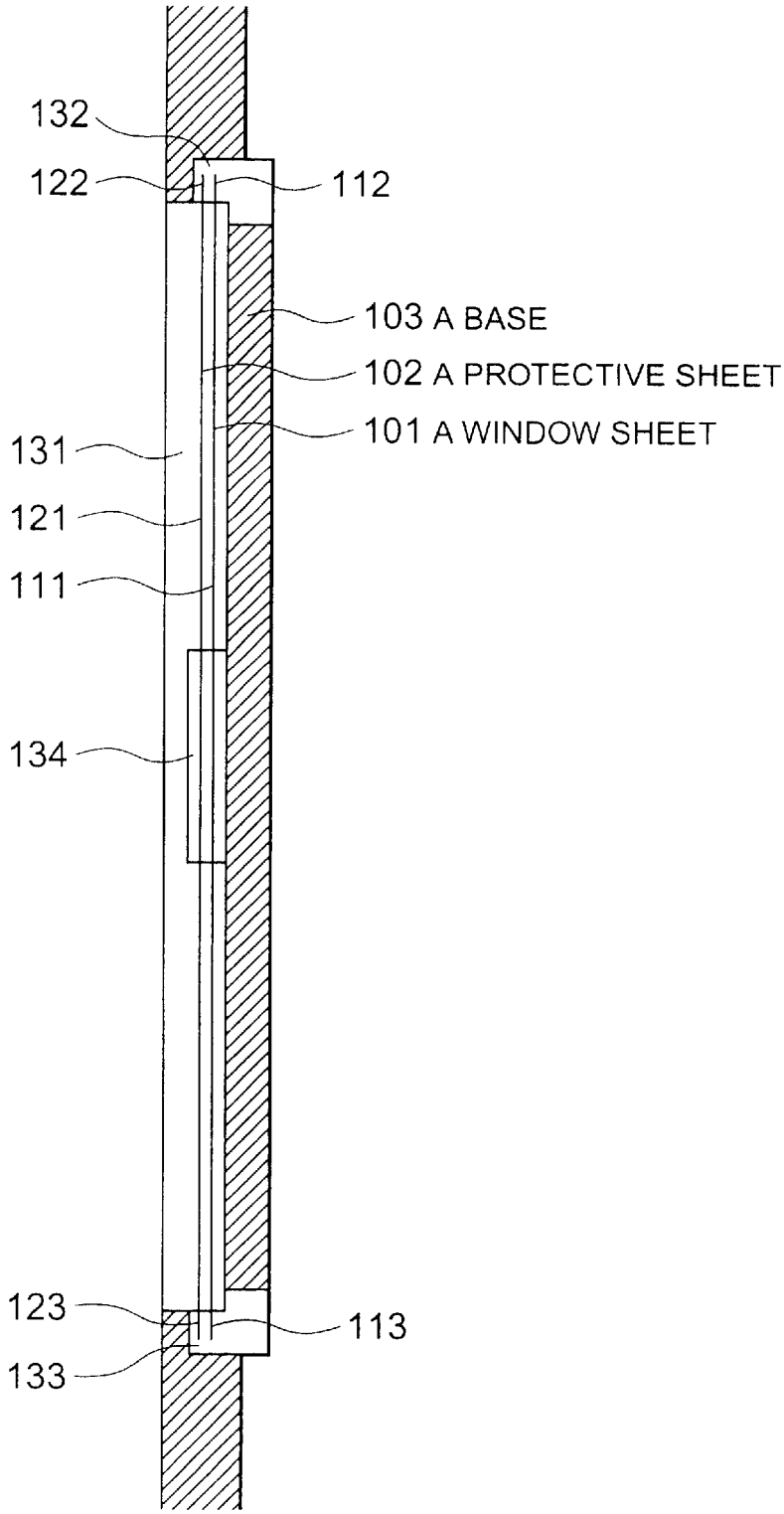
FIG. 1 is a main portion longitudinal sectional view showing the construction of a section window display unit according to the present invention.
Figure 2:
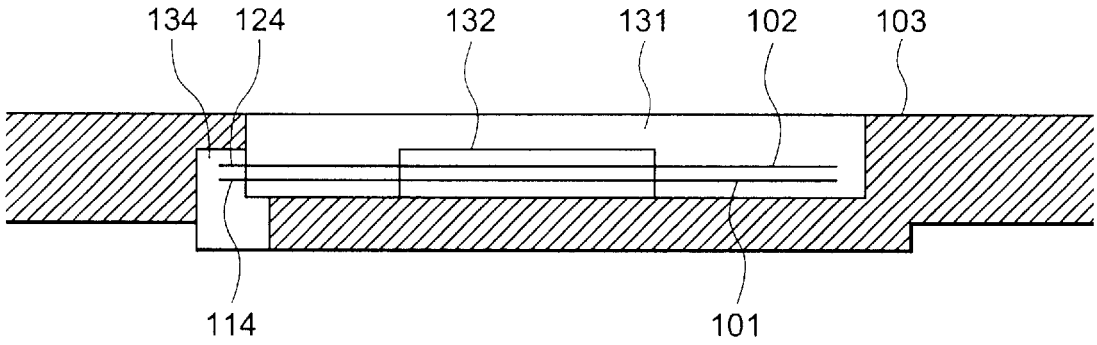
FIG. 2 is a cross-sectional view of FIG. 1, which is taken in a different direction from FIG. 1.

The first embodiment of the present invention will now be described.

First, a section window display unit according to the present invention will be described.

In the drawing, a window sheet 101 has a rectangular planar portion 111 to which the names of sections are written. At the longitudinal ends of the planar portion 111, there are formed engagement members 112 and 113 to be engaged with engagement grooves 132 and 133 of a frame 131 of a base 103, and, at the center of the planar portion 111, there is formed a central engagement member 114 to be engaged with a central engagement groove 134 of the frame 131.

A protective sheet 102 is of the same configuration as the window sheet 101, and has a rectangular planar portion 121 having at the longitudinal ends thereof engagement members 122 and 123 to be engaged with the engagement grooves 132 and 133 of the frame 131 of the base 103. At the center of the planar portion 121, there is formed a central engagement member 124 to be engaged with the central engagement groove 134 of the frame 131. The protective sheet 102 is formed of a substantially transparent resin, and can be easily bent by the fingers when it is attached to the frame 131.

The base 103 has two frames 131 into which the window sheet 101 and the protective sheet 102 are fitted, a plurality of insertion holes 135 and 136 in which LEDs for indicating fire and LEDs for indicating the activation state (not shown) corresponding to a plurality of sections set on the window sheet 101 fitted into the frame 131, and a plurality of insertion holes 137 in which push-buttons serving as activation switches (not shown) are arranged. While in the case of this base 103 four sections are set for one frame 131, it is possible to set any number of sections.

Formed at the longitudinal ends of the rectangular frame 131 of the base 103, into which the window sheet 101 and the protective sheet 102 are fitted, are engagement grooves 132 and 133. Further, the central engagement groove 134 is formed at the center of the left-hand side thereof.

Figure 9:
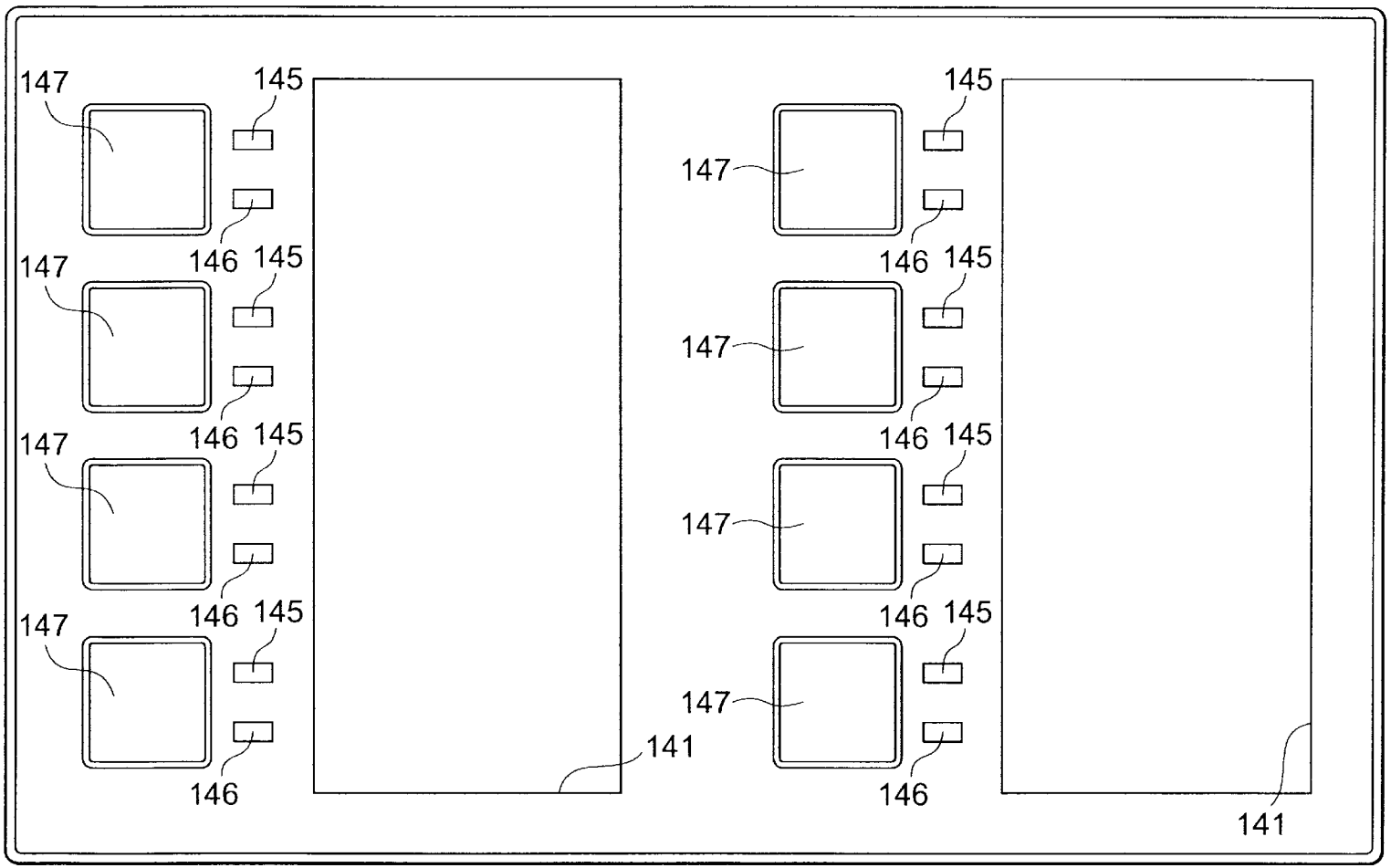
FIG. 9 is an outward view of a membrane sheet attached to the front surface of the base.

A membrane sheet 104 consists of a single sheet on which printing is effected as shown in FIG. 9 and which is attached to the front side of the base 103. There is formed an opening 141 corresponding to the frame 131 of the base 103, and there are formed by printing fire indicating portions 145 and activation state indicating portions 146 corresponding to the LEDs for indicating fire and the LEDs for indicating the activation state (not shown), and activation switch portions 147 corresponding to push-buttons (not shown).

Figure 3:
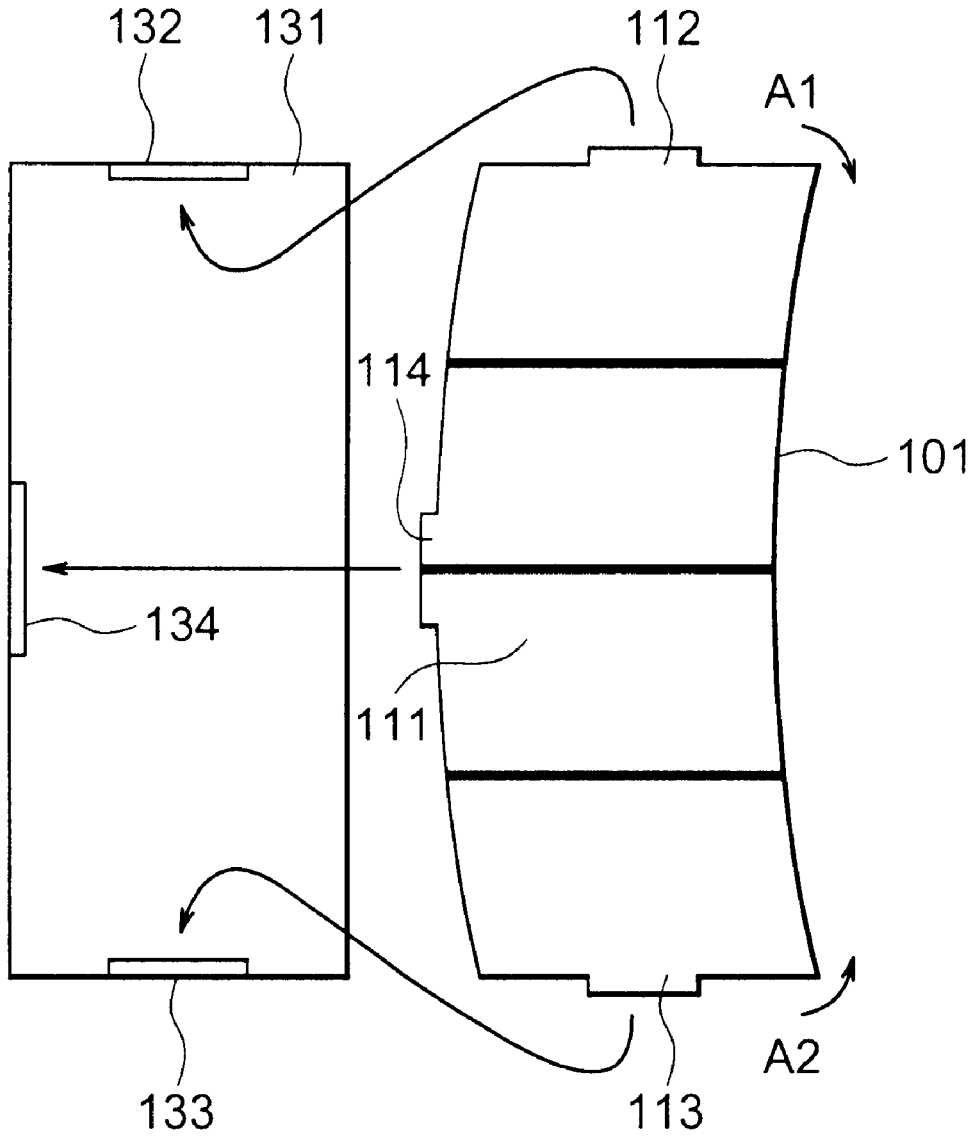
FIG. 3 is an outward view showing how a window sheet is matched with the frame shown in FIG. 1.

To form section window display units U (section window display units Ua through Uf in FIG. 11) of these members, there is first provided the window sheet 101 to whose planar portion 111 the sections to be set have been inscribed with respect to the frame 131 of the base 103, and while bending the window sheet 101 in the directions of the arrows A1 and A2 in conformity with the frame as shown in FIG. 3, the sheet is fitted into the frame 131 of the base 103, whereby the engagement members 112 and 113 formed at the longitudinal ends of the window sheet 101 are engaged with the engagement grooves 132 and 133 of the frame 131 and, at the same time, the central engagement member 114 of the window sheet 101 is engaged with the central engagement groove 134 of the frame 131 for attachment.

Next, like the window sheet 101, the protective sheet 102 is provided, and while bending it in conformity with the frame, the protective sheet 102 is fitted into the frame 131 of the base 103, where by the engagement members 122 and 123 formed at the longitudinal ends of the protective sheet 102 are engaged with the engagement grooves 132 and 133 of the frame 131 and, at the same time, the central engagement member 124 of the protective sheet 102 is engaged with the central engagement groove 134 of the frame 131 for attachment.

The window sheet 101 and the protective sheet 102 are of the same configuration, and their fixation to the frame 131 can be effected through engagement of the engagement members 112 and 113 or the engagement members 122 and 123 with the engagement grooves 132 and 133. With the engagement at the longitudinal ends alone, the central portions of the planar portions 111 and 121 would be allowed to be raised to cancel either of the engagements; if one is detached, the other will be displaced and detached from the frame 131. However, the central engagement members 114 and 124 are formed at the center of the planar portions 111 and 121, and are engaged with the central engagement groove 134, whereby rising of the planar portions 111 and 121 is prevented and their detachment from the frame 131 can be prevented.

Since the window sheet 101 is fixed by the protective sheet 102, there is no need to form a member for preventing detachment from the frame 131 on the window sheet 101, and it is only necessary to provide one on the planar portion 111 in conformity with the frame 131. However, it is more desirable that the window sheet 101 be attached to the frame 131 by itself, and, by inserting the engagement members 112 and 113 and the central engagement member 114 of the window sheet 101 into the engagement grooves 132 and 133 and the central engagement groove 134 of the frame 131, the play of the engagement members 122 and 123 and the central engagement member 124 of the protective sheet 102 is eliminated and they become less subject to detachment.

Further, while the central engagement members 114 and 124 of the window sheet 101 and the protective sheet 102 are only provided on one end of the central portions of the planar portions 111 and 121, it is also possible to provide them on both ends, which strengthens the engagement. However, as far as the attaching/detaching operation is concerned, it is more desirable to provide them on one end only.

Figure 4:
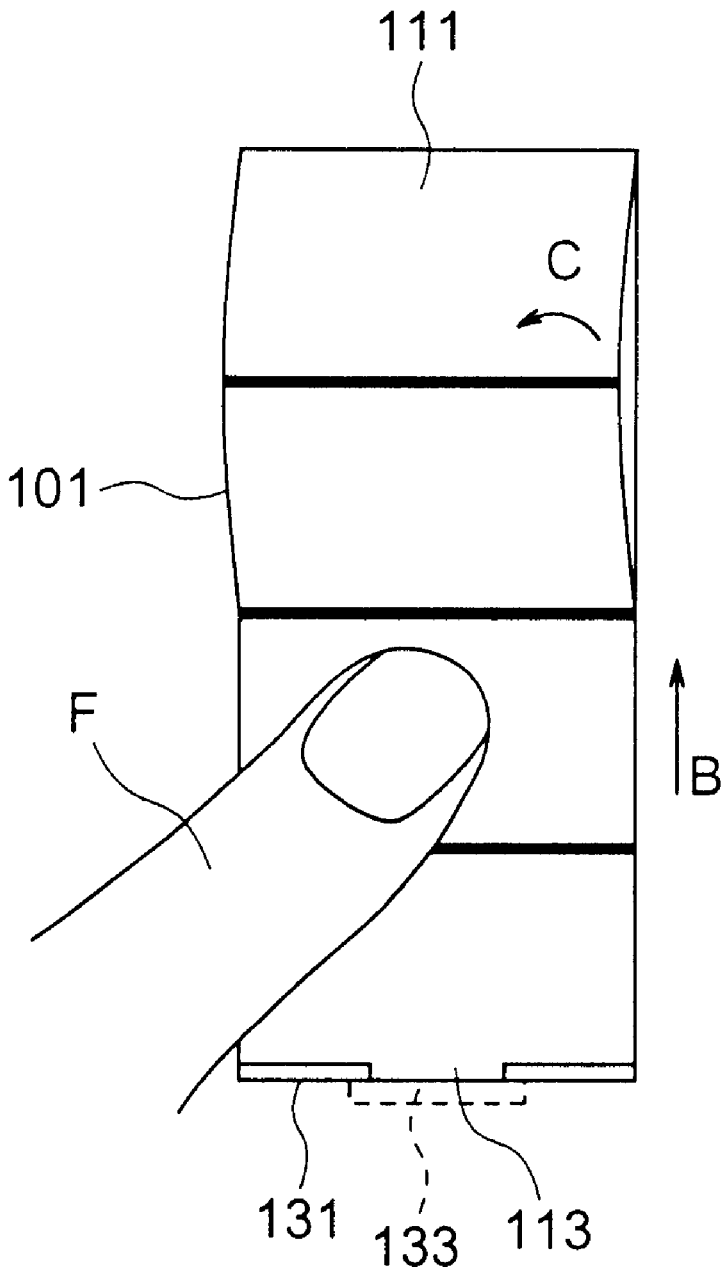
FIG. 4 is an outward view showing how the window sheet is displaced within the frame of FIG. 1.
Figure 5:
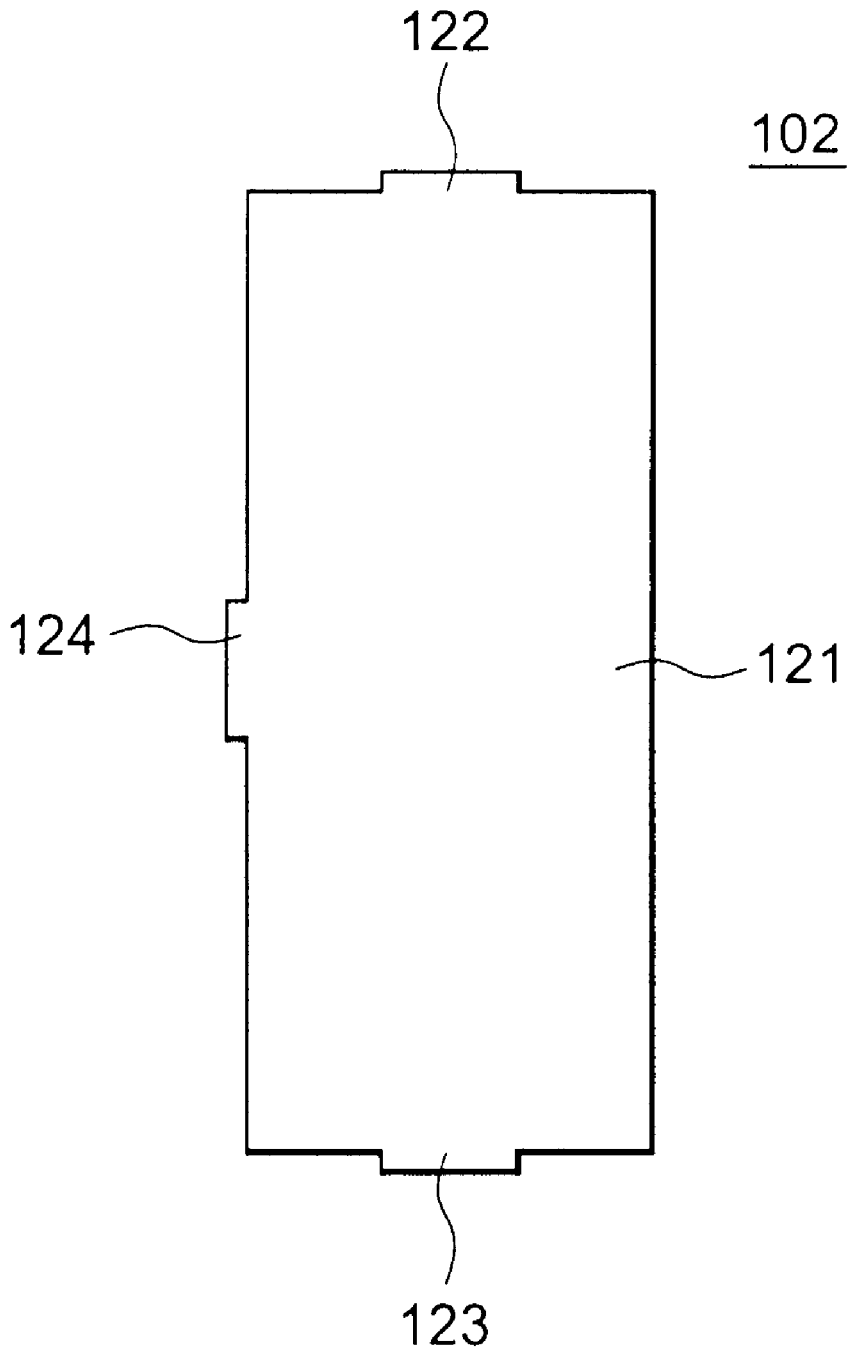
FIG. 5 is an outward view of the protective sheet of FIG. 1.
Figure 6:
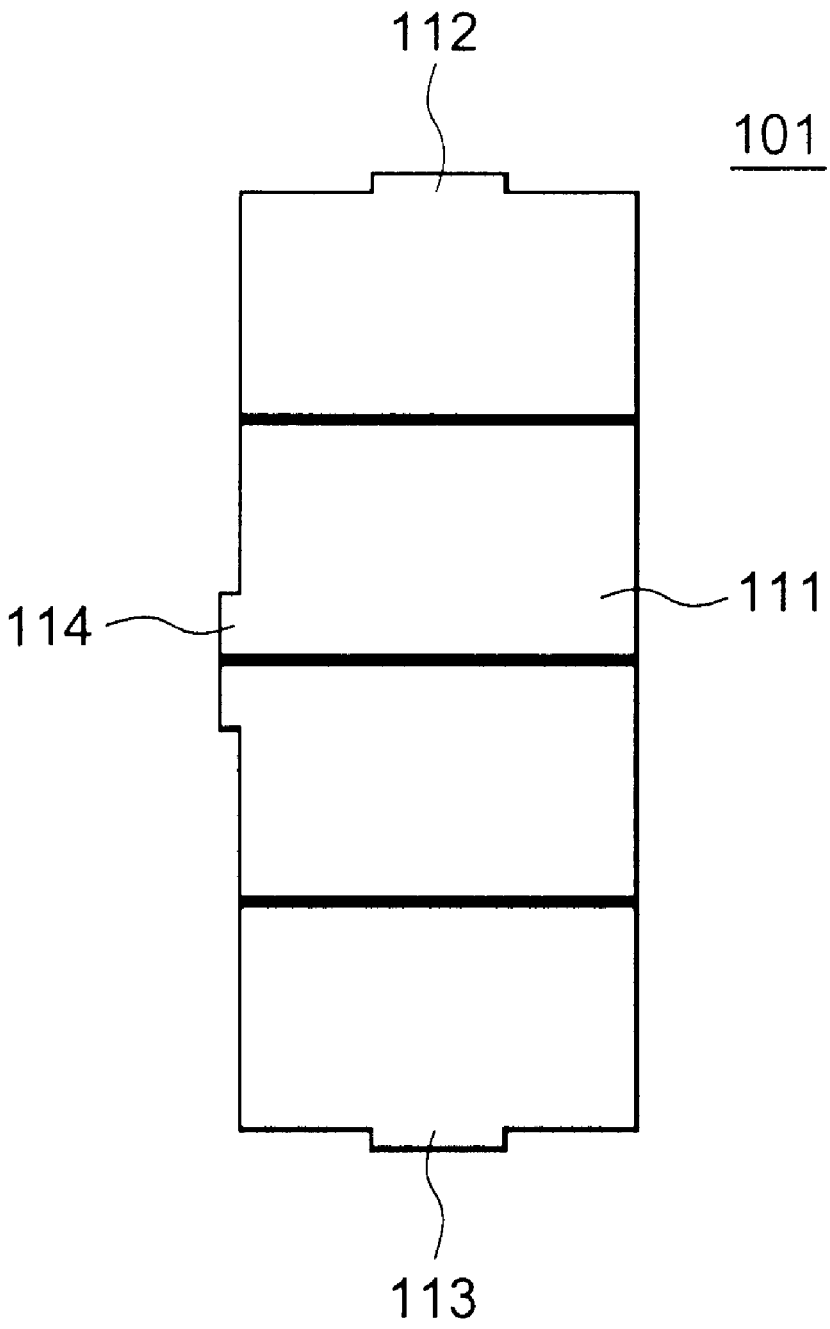
FIG. 6 is an outward view of the window sheet of FIG. 1.
Figure 7:
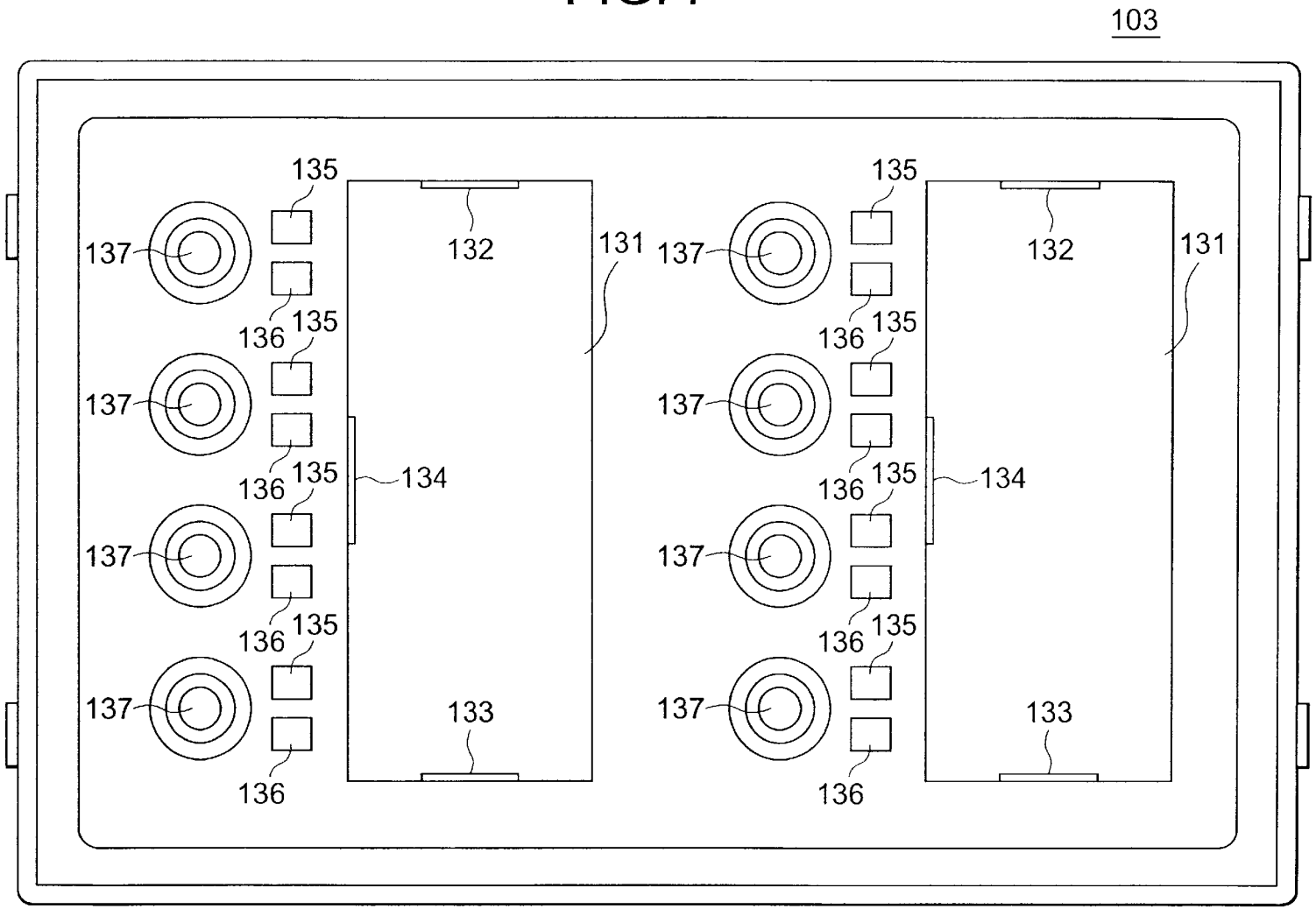
FIG. 7 is a front view of the base of FIG. 1.
Figure 8:
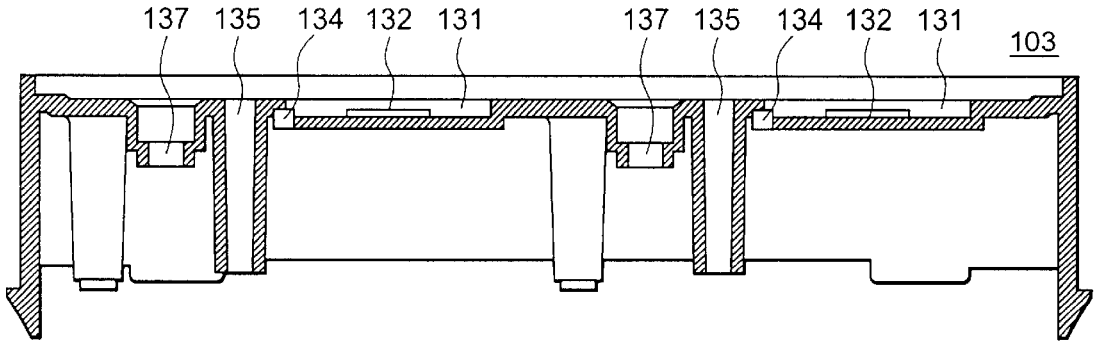
FIG. 8 is a cross-sectional view of FIG. 7.

Conversely, when detaching the protective sheet 102 or the window sheet 101 from the frame 131 of the base 103, the window sheet 101 is pushed and displaced in the direction of the arrow B by the finger F, as shown in FIG. 4, and, when the planar portion 111 of the window sheet 101 is raised as indicated by the arrow C and the engagement member 113 is detached from the engagement groove 133, the window sheet 101 can be gripped and extracted. The protective sheet 102 can be detached in the same manner.

In order that the protective sheet 102 or the window sheet 101 may be displaced by the finger F, the width of the central engagement members 114 and 124 is made smaller than the width of the central engagement groove 134, so that the central engagement members 114 and 124 can move within the range of the width of the central engagement groove 134, thereby enabling the protective sheet 102 or the window sheet 101 to be displaced.

The section window display unit U, constructed as described above, is equipped with requisite members (not shown) and the membrane sheet 104 is attached to the front side thereof, a requisite number of them being provided in a fire receiver. In the fire receiver shown in FIGS. 10 and 11, there are provided six section window display units Ua through Uf, which are visible from outside through openings 41*a* through 41*e* and 42*f* formed in the door 4 of the fire receiver, thus functioning as section window indicating portions.

In this fire receiver, a fire indicating portion 145, an activation state indicating portion 146, and an activation switch portion 147 are arranged in the vicinity with respect to each section set on the window sheet 101, and an occurrence of fire is indicated by lighting up the corresponding fire indicating portion 145. Further, by depressing the activation switch portion 147, the control apparatus (smoke control and venting apparatus, fire extinguishing apparatus or the like) of the corresponding section is activated, and, by lighting up the activation state indicating portion 146, it is indicated that the control apparatus of the corresponding section is activated. The functions of such indicating lamps, switches, etc. can be selectively added or deleted according to the system configuration or the equipment type.

Here, the planar portion 111 of the window sheet 101 is longitudinally divided into four (or any other arbitrary number of) section inscription portions. By thus dividing the planar portion into a plurality of portions, a plurality of sections can be dealt with in a single window sheet 101, thereby increasing the window setting density. Further, if a plurality of section inscription portions are longitudinally connected, it is possible to arrange indicating portions such as the fire indicating portions 145 and operating portions such as activation switch portions 147 regarding each section laterally with respect to the corresponding section inscription portions, thereby achieving compactness in space.

The section window display unit U can also be provided in a fire annunciator for indicating a section on fire as in the case of the installation in a fire receiver. Further, what is to be indicated is not restricted to fire. It can also be utilized as an indication panel for indicating a monitoring area of a security system or an indication panel for indicating the control of power source, illumination, etc.

Figure 10:
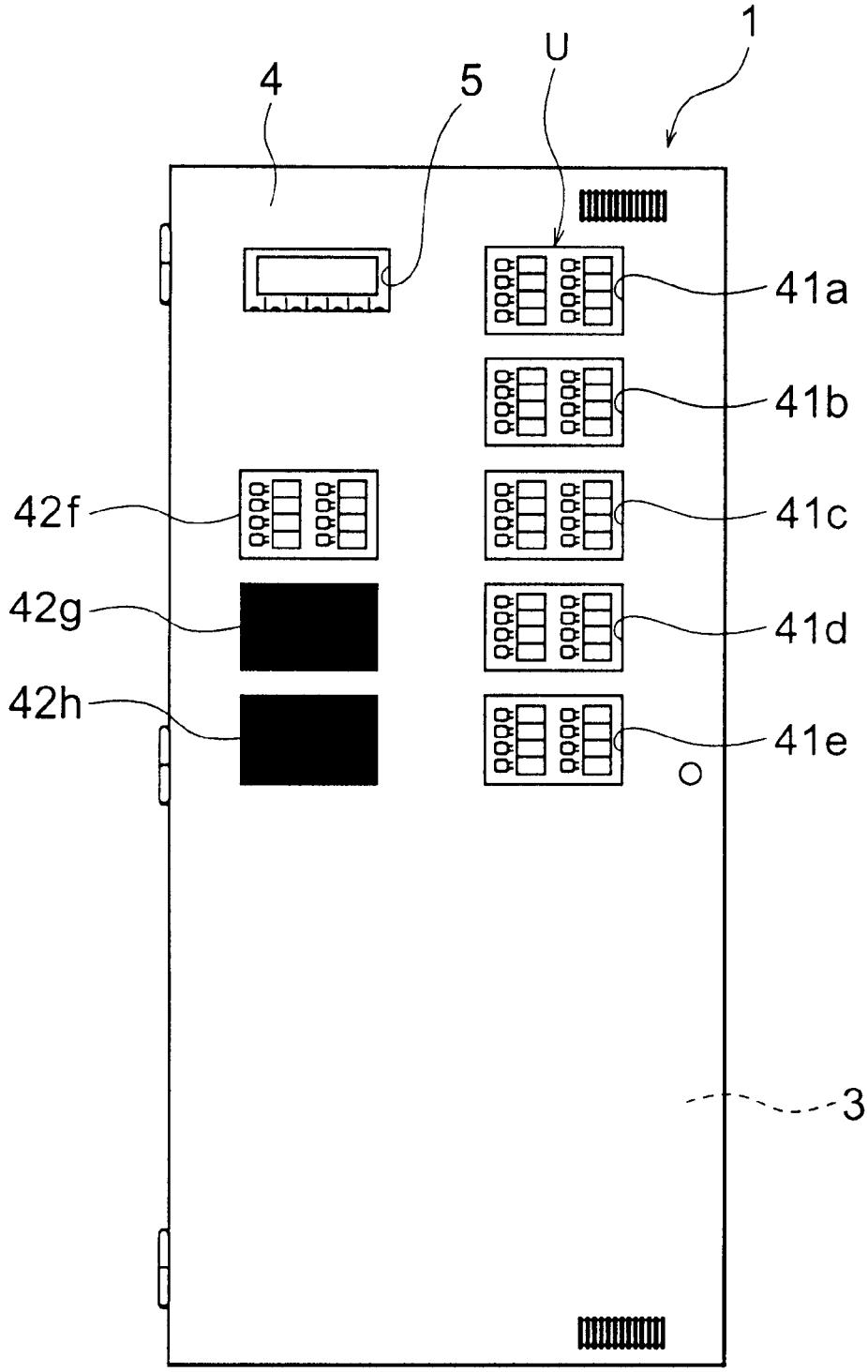
FIG. 10 is a front view of a panel surface of a fire receiver according to a first embodiment of the present invention.
Figure 11:
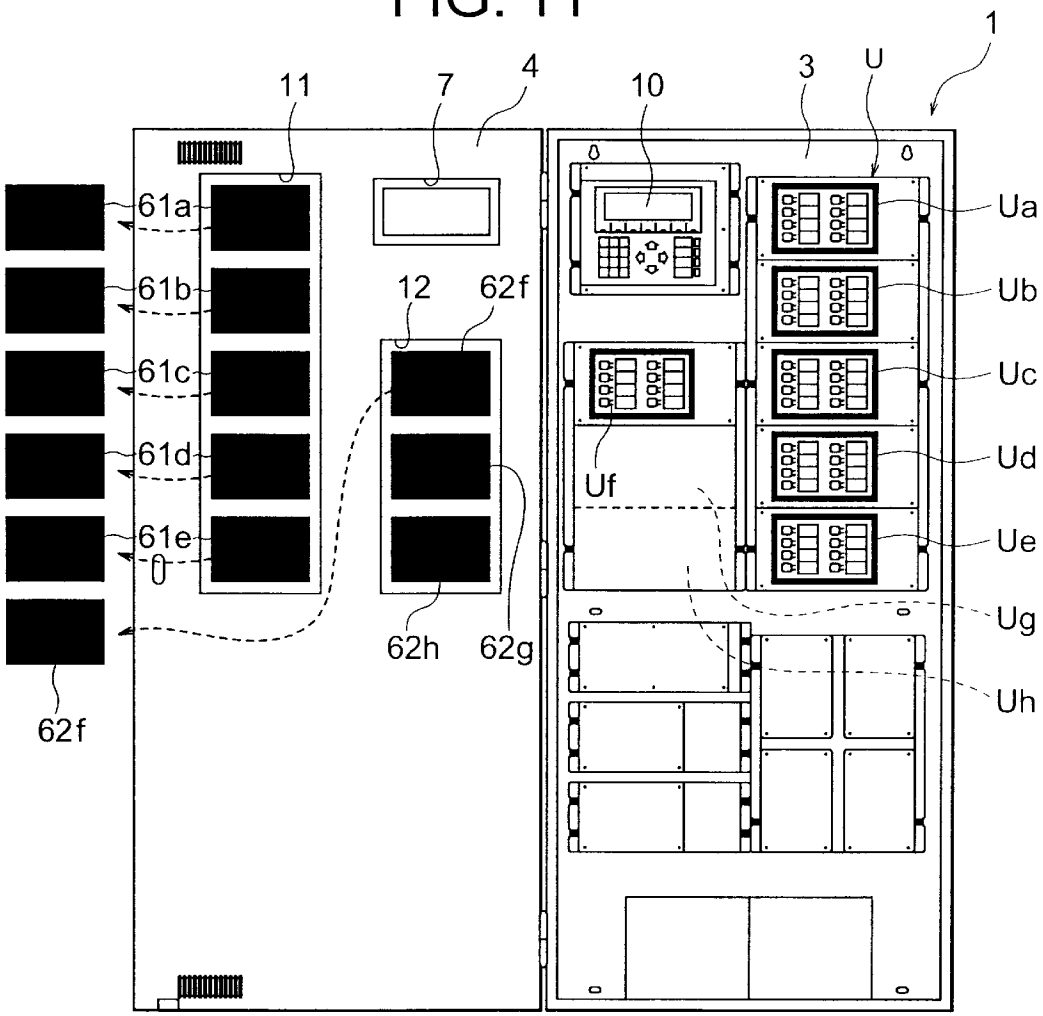
FIG. 11 is a front view of the fire receiver of the first embodiment of the present invention in the assembly state with its door open.

Next, the fire receiver shown in FIGS. 10 and 11 will be described in detail.

This fire receiver allows provision of section window display units U at predetermined positions in the main body 3 (five on the right-hand side and three on the left-hand side, i.e., eight in total). In FIG. 11, there are provided, according to the number of monitoring sections set in the building, five display units Ua through Ue on the right-hand side, and one display unit Uf on the left-hand side, i.e., six section window display units U (Although not shown, it is possible to provide two display units Ug and Uh below the display unit Uf). Further, provided in the main body 3 are a main operating portion 10 for performing various settings on terminal devices such as fire sensors arranged in the monitoring sections, a power source unit (not shown), etc. The section window display units U may be of other section window indicator types; it may be a fire section indicating system of the type which indicates a number or character indicating a section on fire by using a so-called seven segment display or a liquid crystal display (LCD).

The door 4 constituting the main body 3 has a main opening 5 in correspondence with the main operating portion 10, and a main transparent protective plate 7 is mounted thereto so as to cover the main opening 5. Further, formed in the door 4 are eight openings 41*a* through 41*e* and 42*f* through 42*h* in correspondence with eight display units provided at predetermined positions (three on the left-hand side, and five on the right-hand side) in the main body 3.

The openings 41*a* through 41*e* and the openings 42*f* through 42*h* are respectively formed in a row in the door 4. Further, substantially rectangular transparent protective plates 11 and 12 which are transparent protecting means formed, e.g., of an acrylic material are attached to the back side of the door 4 by a double-faced tape or the like so as to cover the openings 41*a* through 41*e* and 42*f* through 42*h*. While the transparent protective plate 11, which is provided for the five display units Ua through Ue arranged in a row on the right-hand side in the main body 3, and the transparent protective plate 12, which is provided for the three display units Uf through Uh arranged in a row on the left-hand side in the main body 3, are each formed of a single transparent protective plate, it is also possible to provide separate transparent protective plates respectively corresponding to the individual openings. However, in the case of the transparent protective plates 11 and 12, the row of openings 41*a* through 41*e* and the row of openings 42*f* through 42*h* can be each covered by a single transparent protective plate, so that the mounting operation is facilitated as compared with the case in which the individual openings are covered by separate transparent protective plates.

Black opaque separable seals 61*a* through 61*e* and 62*f* through 62*h* which are opaque covering means are attached in advance to the surface of the transparent protective plates 11 and 12 on the opposite side of the door mounting surface in correspondence with the openings 41*a* through 41*e* and 42*f* through 42*h*.

In this way, the outside face of this fire receiver is covered by the casing 1 having the main body 3 equipped with the door 4 to which the main transparent protective plate 7 and the transparent protective plates 11 and 12 are attached, and thereby intrusion of dust or the like is prevented.

Next, a method of assembling this fire receiver will be described. First, the requisite components for forming the fire receiver, such as a power source unit (not shown) are mounted in the main body 3. Then, the main setting portion 10 and a requisite number of display units, e.g., five on the right-hand side and one on the left-hand side, i.e., six in total (Ua through Ue and Uf) are mounted in the main body 3 by, for example, screws. Further, the main transparent protective plate 7 is attached to the back side of the door 4 by a double-sided tape or the like so as to cover the opening 5 of the door 4. Further, the door mounting surfaces of the transparent protective plates 11 and 12 and the back surface of the door 4 are attached together by double-sided tapes or the like such that the openings 41*a* through 41*e* and 42*f* through 42*h* of the door 4 are respectively covered by the opaque seals 61*a* through 61*e* and 62*f* through 62*h* attached to the transparent protective plates 11 and 12 in advance. Furthermore, the opaque seals 61*a* through 61*e* and 62*f* corresponding to the display units Ua through Ue and Uf are separated from the transparent protective plates 11 and 12 and the door 4 is closed, and thereby the operation is completed.

In the casing 1 of this fire receiver, a requisite number of display units Ua through Ue and Uf are provided in the main body 3, and the opaque seals 62*g* and 62*h* are attached to the transparent protective plate 12 in correspondence with the openings 42*g* and 42*h* corresponding to other than the display units Ua through Ue and Uf.

Thus, the watchman monitoring this fire receiver provided in a building or the like can visually check the indication of the six display units Ua through Ue and Uf provided in the casing 1 at a glance from the outside through the transparent protective plates 11 and 12.

Since the indication of the display units can be visually checked from outside the casing by separating the opaque seals corresponding to the requisite number of display units from the transparent protective plates, so that if the system is to be installed in buildings or the like requiring different numbers of display units, the casing only requires one type of door. Thus, a reduction in parts cost is achieved, and stock control in plant and shipping are facilitated. Further, the number of display units can be easily increased or decreased by adding or removing the opaque seals after installation.

While in the above example the color of the opaque seals is black, any color will do as long as it prevents the interior of the casing from being seen from outside. When the opaque seals are the same color as the door, the openings corresponding to other than the display units provided in the main body become less conspicuous, which is desirable in terms of outward appearance.

Further, instead of attaching the opaque seals to the transparent protective plates in advance, it is also possible to attach the opaque seals to the transparent protective plates in correspondence with the openings corresponding to other than the display units provided in the main body.

Figure 12:
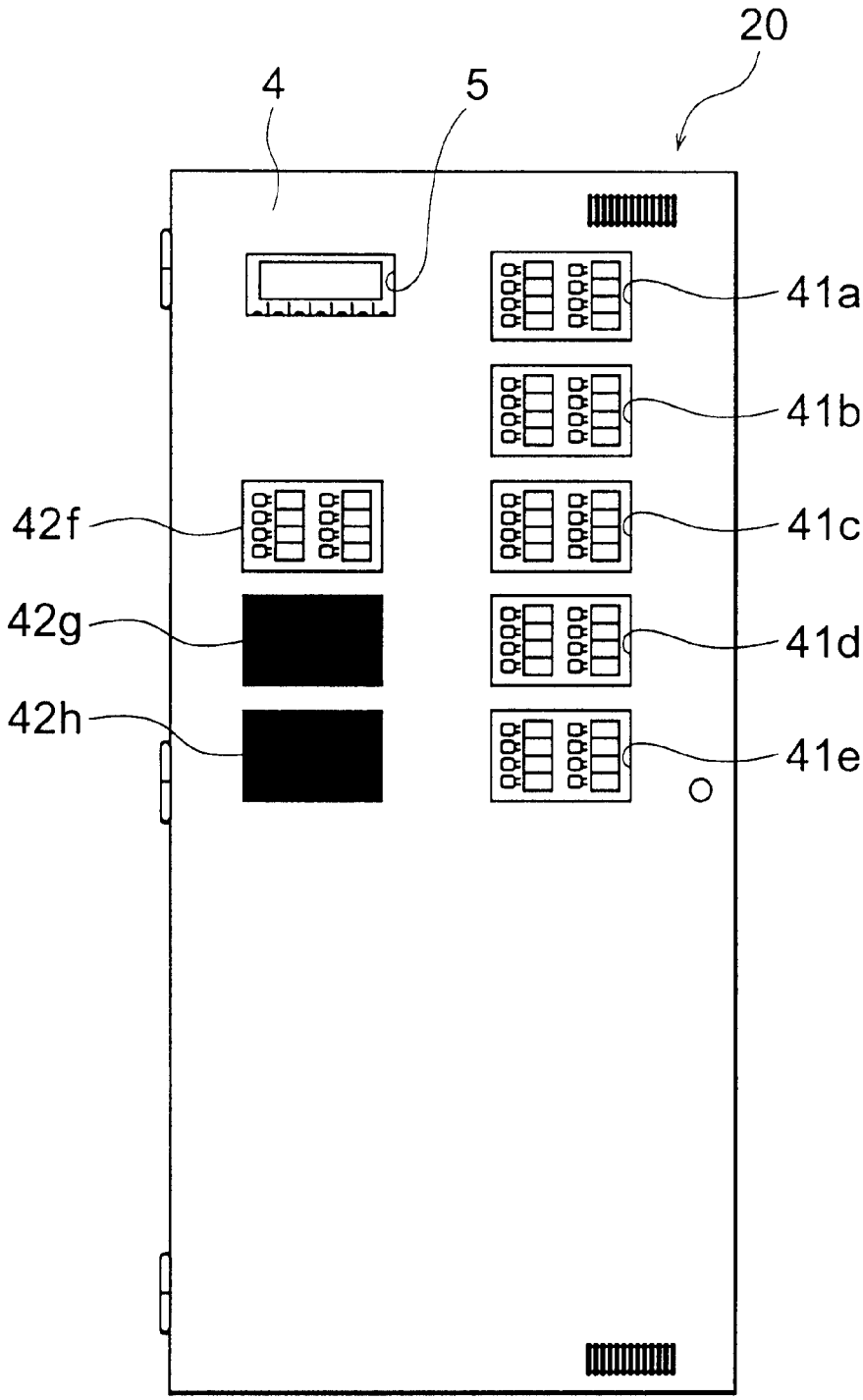
FIG. 12 is a front view of a panel surface of a fire receiver according to a second embodiment of the present invention.
Figure 13:
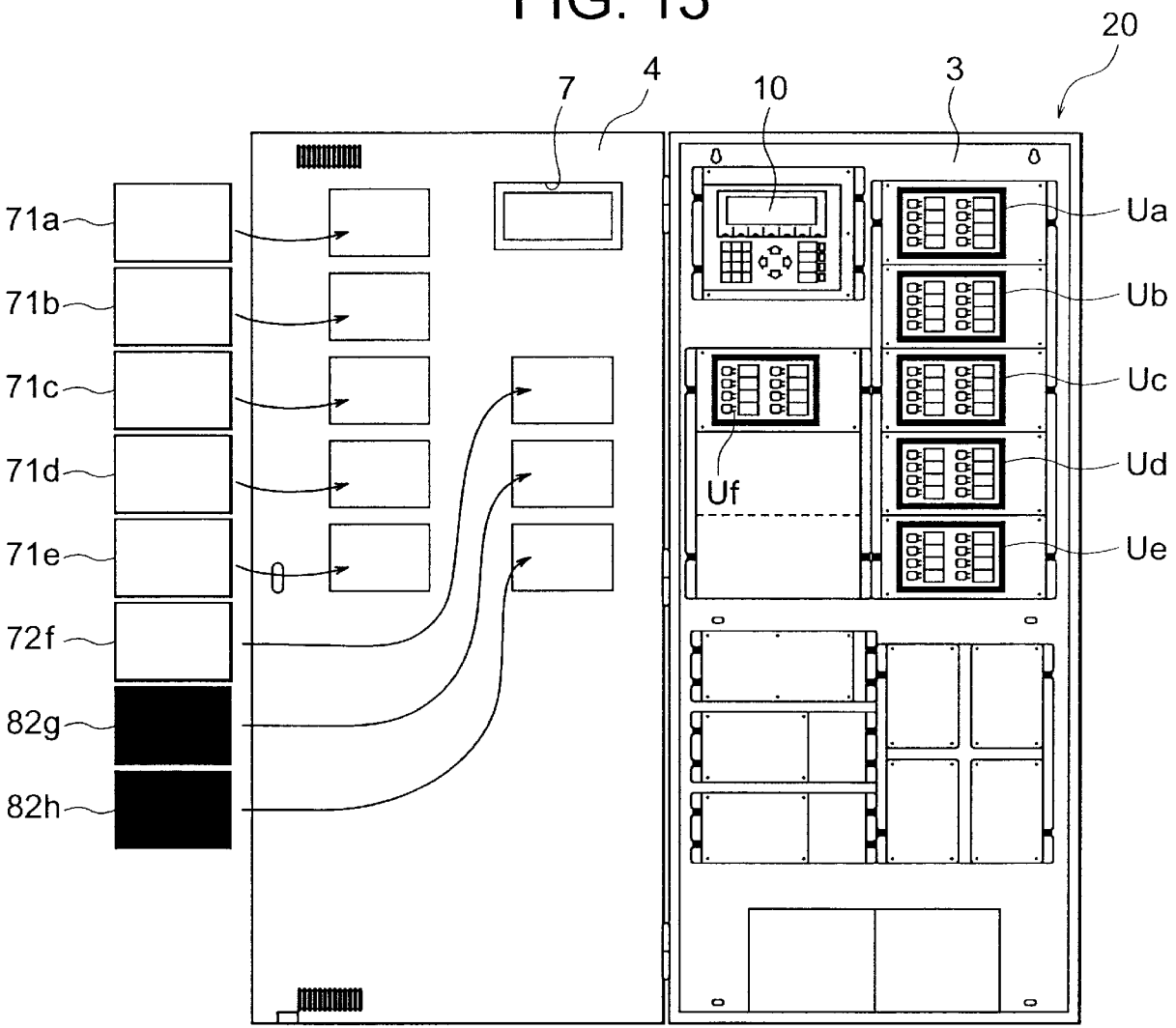
FIG. 13 is a front view of the fire receiver of the second embodiment of the present invention in the assembly state with its door open.

A second embodiment of the present invention will be described with reference to FIGS. 12 and 13, which illustrate a fire receiver. FIG. 12 is a front view of a unit panel, and FIG. 13 is a front view of the same in the assembly state with its door open.

In the casing 20 of this fire receiver, transparent protective plates 71*a* through 71*e* and 72*f* and opaque protective plates 82*g* and 82*h* selectively constituting the protective means are used instead of the transparent protective plates 11 and 12 and the opaque seals 61*a* through 61*e* and 62*f* through 62*h*, making it possible to visually check from outside the casing the indication of the display units provided in the casing. The transparent protective plates 71*a* through 71*e* and 72*f* and the opaque protective plates 82*g* and 82*h* are substantially rectangular and formed of, for example, an acrylic material. They are attached to the door to selectively cover the openings. The color of the opaque protective plates 82*g* and 82*h* is black.

Next, a method of assembling the fire receiver of the second embodiment will be described. First, the requisite components (not shown) for forming the fire receiver, such as a power source unit, are mounted in the main body 3. Then, a main setting portion 10 and a requisite number of display units, for example, five on the right-hand side and one on the left-hand side, i.e., six display units Ua through Ue and Uf in total, as shown in FIG. 13 are mounted in the main body 3 by screws or the like. Further, a main protective plate 7 is attached to the back side of the door 4 by a double-sided tape or the like so as to cover the opening 5 of the door 4. Then, the door mounting surfaces of the transparent protective plates 71*a* through 71*e* and 72*f* and the back surface of the door 4 are attached together by a double-sided tape or the like to mount the transparent protective plates 71*a* through 71*e* and 72*f* to the back surface of the door 4 so as to cover openings 41*a* through 41*e* and 42*f* of the door 4. Further, the door mounting surfaces of the opaque protective plates 82*g* and 82*h* and the back surface of the door 4 are attached together by a double-sided tape or the like so as to mount the opaque protective plates 82*g* and 82*h* to the back surface of the door 4 so as to cover openings 42*g* and 42*h*. When the door 4 is closed, the operation is completed.

In the casing 20 of this fire receiver, a requisite number of display units Ua through Ue and Uf are provided in the main body 3, transparent protective plates 71*a* through 71*e* and 72*f* covering the openings 41*a* through 41*e* and 42*f* corresponding to the display units Ua through Ue and Uf are mounted to the door 4, and the opaque protective plates 82*g* and 82*h* covering the openings 42*g* and 42*h* to which the transparent protective plates 71*a* through 71*e* and 72*f* are not mounted are mounted to the door 4.

Thus, the watchman monitoring this fire receiver installed in a building or the like can visually check the indication of the six display units Ua through Ue and Uf provided in the casing 20 at a glance from outside the casing 20 through the transparent protective plates 71*a* through 71*e* and 72*f*.

In the casing, the transparent protective plates are mounted to the door so as to cover the openings corresponding to the requisite number of display units, and the opaque protective plates are mounted so as to cover the openings to which the transparent protective plates are not mounted, and thereby the indication of the display units can be visually checked from outside the casing, so that one type of door can be adapted to installation places requiring different numbers of display units. Thus, a reduction in parts cost is achieved, and stock control in plant and shipping are facilitated. Further, the number of display units can be easily increased or decreased after installation.

While in the above example the color of the opaque seals is black, any color will do as long as it prevents the interior of the casing from being seen from outside. When the opaque seals are the same color as the door, the openings corresponding to other than the display units provided in the main body become less conspicuous, which is desirable in terms of outward appearance.

Figure 14:
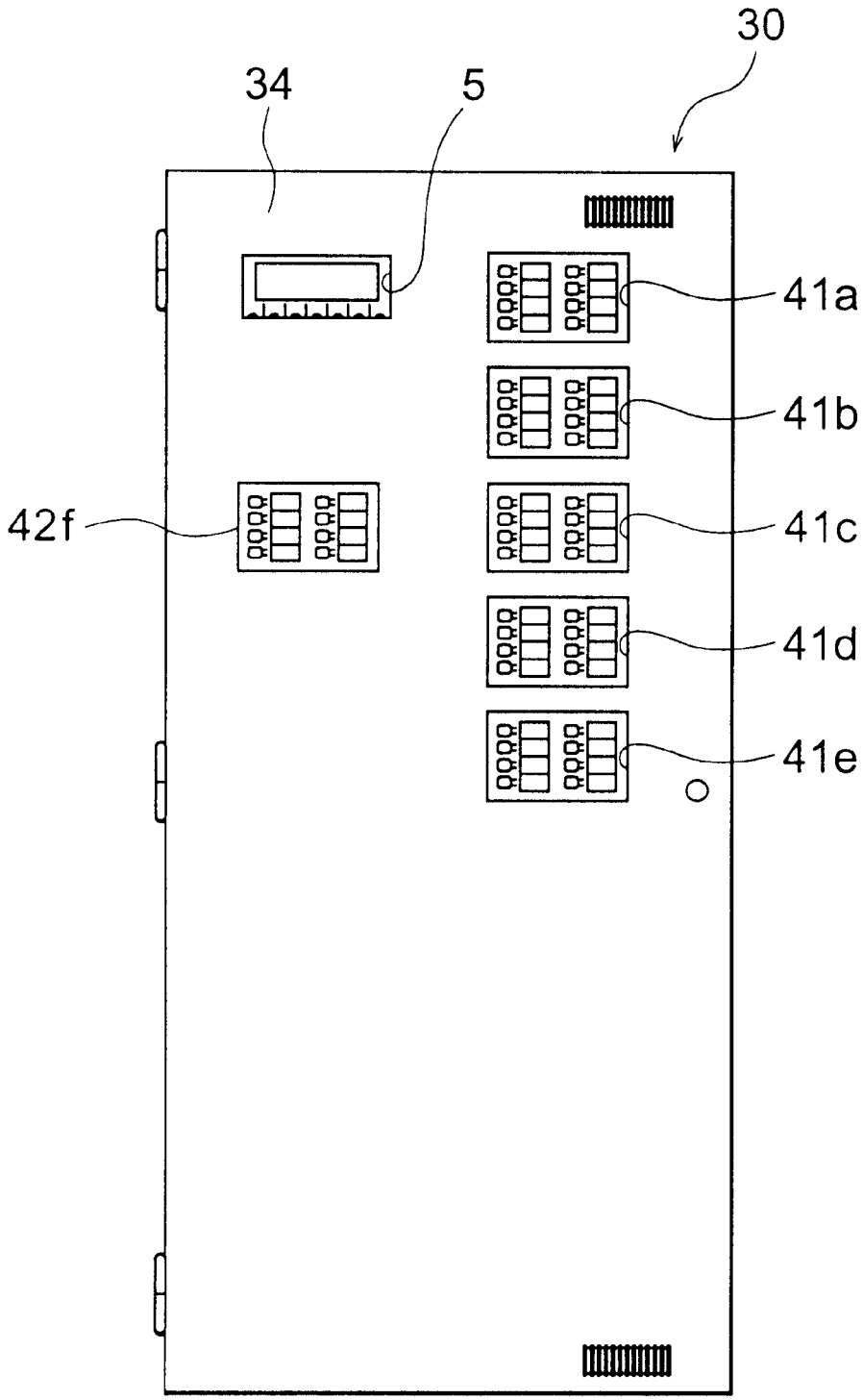
FIG. 14 is a front view of a panel surface of a fire receiver according to a third embodiment of the present invention.
Figure 15:
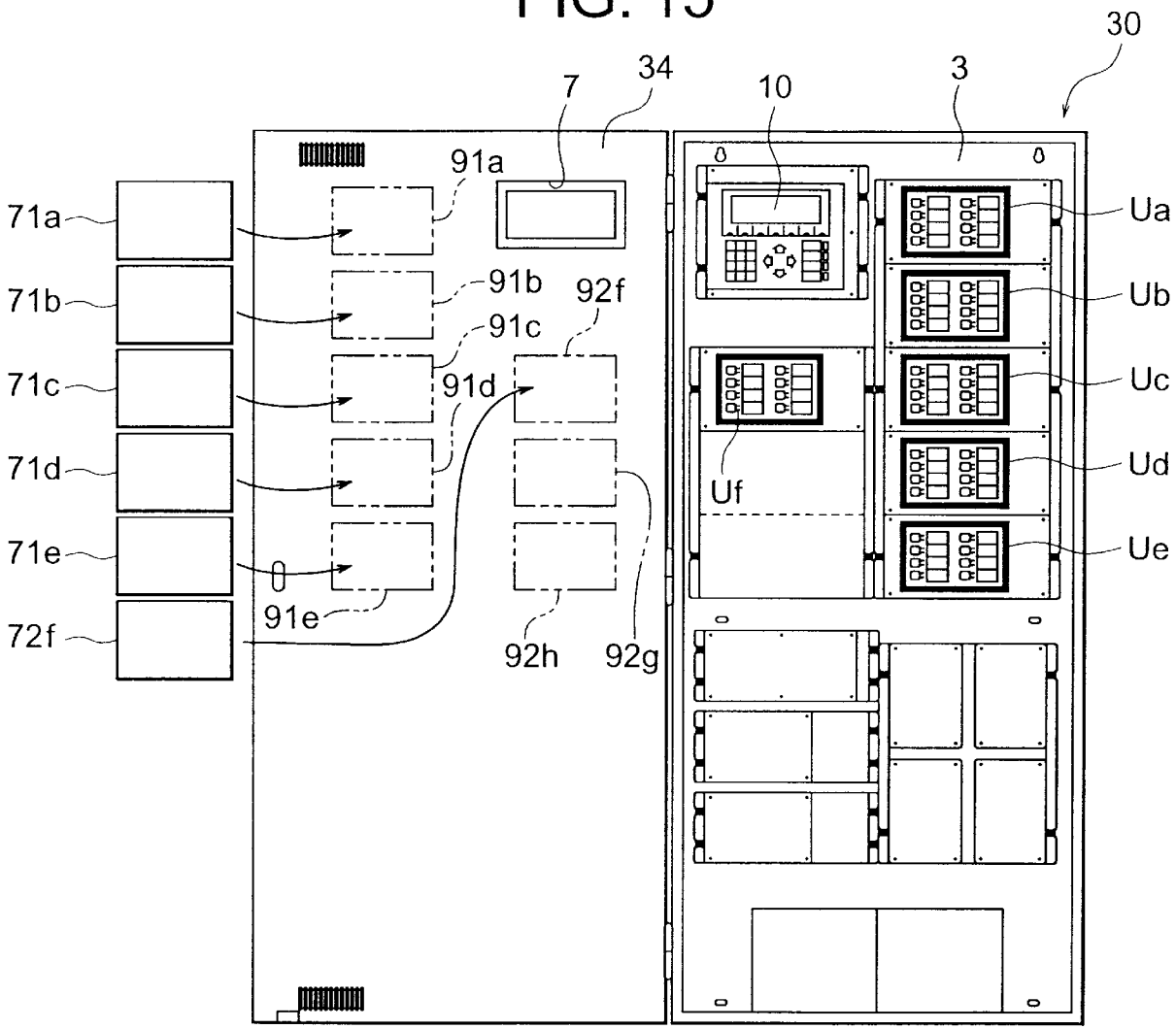
FIG. 15 is a front view of the fire receiver of the third embodiment of the present invention in the assembly state with its door open.
Figure 16:
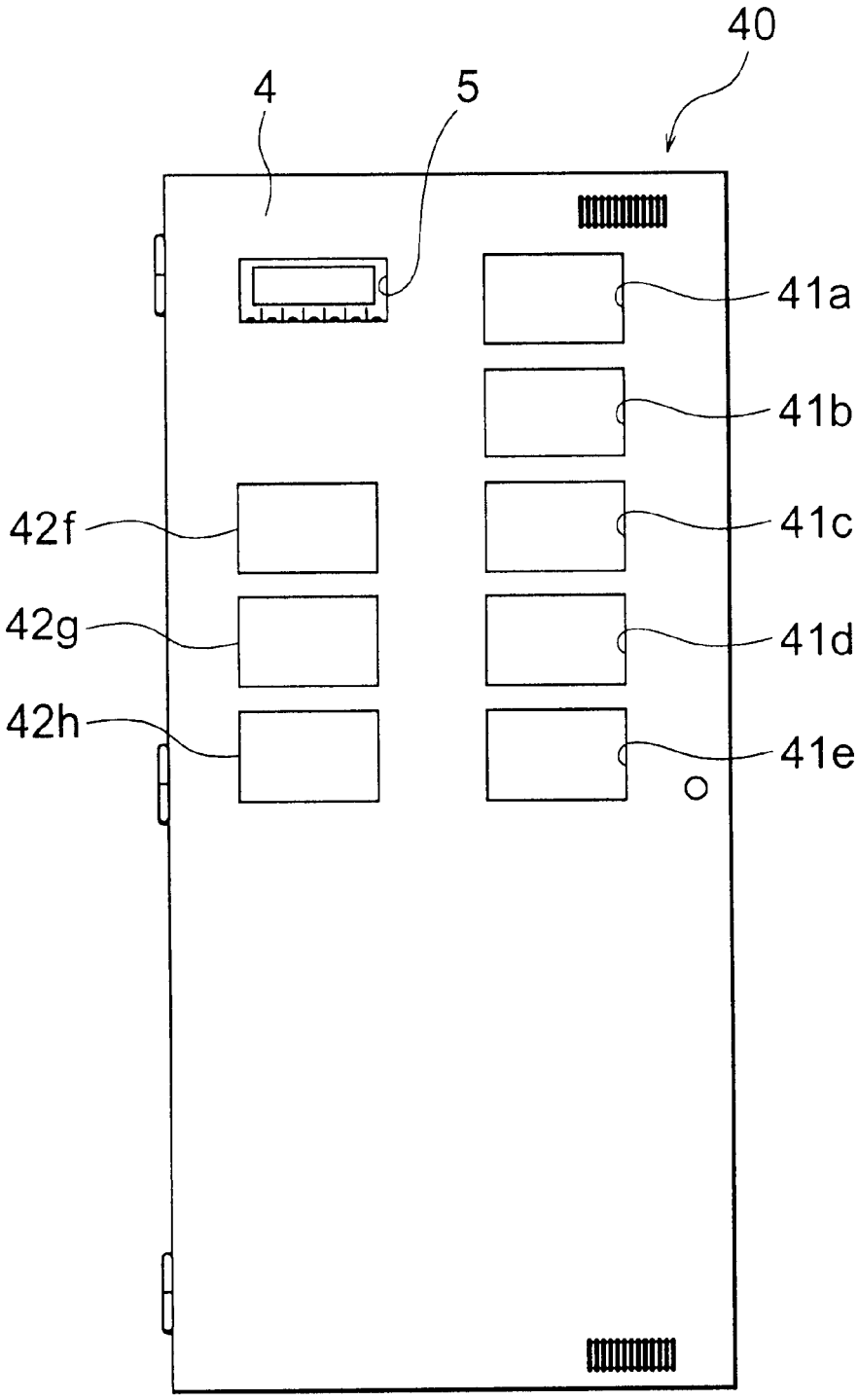
FIG. 16 is a front view of a panel surface of a conventional fire receiver.
Figure 17:
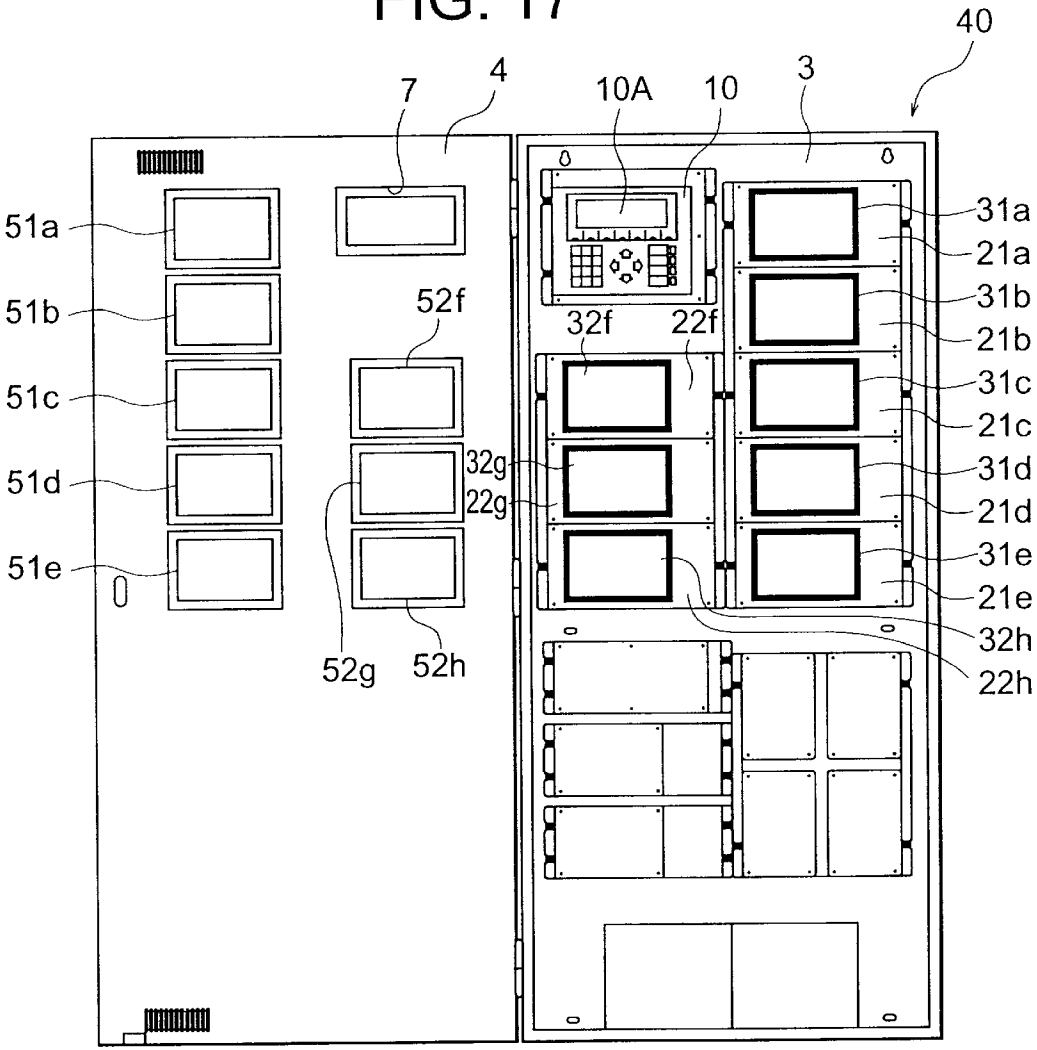
FIG. 17 is a front view of the conventional fire receiver with its door open.

A third embodiment of the present invention will be described with reference to FIGS. 14 and 15, which illustrate a fire receiver. FIG. 14 is a front view of a unit panel, and FIG. 15 is a front view of the same in the assembly state with its door open.

In the casing 30 of this fire receiver, there are provided, instead of the door 4, the transparent protective plates 71*a* through 71*e* and 72*f*, and the opaque protective plates 82*g* and 82*h* of the second embodiment, a door 34, knock-out portions 91*a* through 91*e* and 92*f* through 92*h* formed in the door 34 by making a cut or the like in the back surface of the door 34, and transparent protective plates 71*a* through 71*e* and 72*f* which are transparent protecting means, and thereby the indication of the display units provided in the casing can be visually checked from outside the casing.

Next, a method of assembling the fire receiver of the third embodiment will be described. First, the requisite components (not shown) for forming the fire receiver, such as a power source unit, are mounted in the main body 3. Then, the main setting portion 10, and a requisite number of display units, for example, five on the right-hand side and one on the left-hand side, i.e., six display units Ua through Ue and Uf in total, as shown in FIG. 15, are mounted in the main body 3 by screws or the like. Further, the main transparent protective plate 7 is mounted to the back side of the door 4 by a double-sided tape or the like so as to cover the opening 5 of the door 34. The door 34 has knock-out portions 91*a* through 91*e* and 92*f* through 92*h* provided by making a cut or the like in the back surface of the door 34 beforehand to form openings 41*a* through 41*e* and 42*f* through 42*h* shown in FIG. 13. Then, by knocking the knock-out portions 91*a* through 91*e* and 92*f* by a hammer or the like, the openings 41*a* through 41*e* and 42*f* are formed. Further, the door mounting surfaces of the transparent protective plates 71*a* through 71*e* and 72*f* and the back surface of the door 34 are attached together by a double-sided tape or the like to attach the transparent protective plates 71*a* through 71*e* and 72*f* to the back surface of the door 34 by a double-side tape or the like so as to cover the openings 41*a* through 41*e* and 42*f*. When the door 34 is closed, the operation is completed.

In the casing 30 of this fire receiver, the requisite number of display units Ua through Ue and Uf are provided in the main body 3, and the knock-out portions 91*a* through 91*e* and 92*f* corresponding to the display units Ua through Ue and Uf are knocked out by a hammer or the like to form the openings 41*a* through 41*e* and 42*f*, and the transparent protective plates 71*a* through 71*e* and 71*f* covering the openings 41*a* through 41*e* and 42*f* are attached to the door 34.

Thus, the watchman monitoring this fire receiver installed in a building or the like can visually check the indication of the six display units Ua through Ue and Uf provided in the casing 30 at a glance from outside the casing 30 through the transparent protective plates 71*a* through 71*e* and 72*f*.

In the casing, the knock-out portions corresponding to the requisite number of display units are knocked out to form the openings, and the transparent protective plates are attached to the door so as to cover the openings, and thereby the indication of the display units can be visually checked from outside the casing. Thus, one type of door will do for installation places requiring different numbers of display units. Thus, a reduction in parts cost can be achieved, and stock control in plant and shipping are facilitated. Further, the number of display units can be easily increased after installation.

While in all the above embodiments the transparent protective plates and the opaque protective plates are attached to the back surface of the door by a double-sided tape, any other means will do as long as attachment can be effected. For example, it is also possible to mount screws at predetermined positions around the openings of the door and pass the screws through holes provided in the transparent protective plates and the opaque protective plates in advance, and then fasten the screws by nuts.

Further, while the casings of all the above embodiments are those of fire receivers, this should not be construed restrictively. What is important is that the display units provided in the casing can be visually checked from outside the casing. Thus, it may also be a casing for use in a fire alarm equipment such as a so-called fire annunciator, a central supervisory panel or the like, or a casing for a security system.

As described above, in accordance with the present invention, there are provided a base having a frame for window indication, a rectangular window sheet to which the names of the sections are written and which is fitted into the frame of the base and a rectangular substantially transparent protective sheet which is substantially of the same configuration as the window sheet and arranged in front of it and has at its longitudinal ends engagement members to be engaged with engagement grooves of the frame and at its center a central engagement member to be engaged with a central engagement groove of the frame. The central portion is engaged while effecting engagement at the longitudinal ends to thereby prevent the central portion from rising, and thereby preventing the protective sheet from being detached from the frame.

The window sheet corresponds to a plurality of sections and consists of a rectangular sheet longitudinally divided into a plurality of portions to which the names of the sections can be written. Thus, the indication of a plurality of the sections can be effected with a single sheet. Further, indicating lamps are provided in correspondence with the sections. Thus, the monitoring condition can be appropriately indicated.

Further, the fire receiver includes a main body in which a plurality of display units are provided, a door mounted to the main body so as to be capable of opening and closing, a plurality of openings being formed in advance in the door in correspondence with the positions where the display units can be provided in the main body. The transparent protective means are mounted to the door and adapted to cover plurality of openings, and opaque sealing means attached to positions corresponding to said plurality of openings on said transparent protective means and separable from each opening. Thereby, one type of door can be applied to installation places requiring different numbers of display units. Thus, a reduction in parts cost can be achieved, stock control in the plant and shipping are facilitated, and the number of display units can be easily increased or decreased after installation.

The above-mentioned transparent protective means comprises at least one transparent protective plate. The one transparent protective plate collectively covers a plurality of the openings provided in a row in the door, and thereby the operation of mounting the transparent protective plate is facilitated.

When the opaque covering means and the opaque protective plate are substantially the same color as the door, the openings corresponding to other than the display units provided in the main body become less conspicuous, which is desirable in terms of outward appearance.

Further, the fire receiver includes a main body in which a plurality of display units are provided, a door mounted to the main body so as to be capable of opening and closing, a plurality of openings formed in advance in the door in correspondence with the positions where the display units can be provided in the main body, and protective means consisting of a plurality of plates selected from a plurality of transparent protective plates and a plurality of opaque protective plates and mounted to the door to cover the plurality of openings. Thereby, one type of door can be applied to installation places requiring different numbers of display units. Thus, a reduction in parts cost can be achieved, stock control in the plant and shipping are facilitated, and the number of display units can be easily increased or decreased after installation.

Further, the fire receiver includes a main body in which a plurality of display units are provided, a door mounted to the main body so as to be capable of opening and closing, a plurality of knock-out portions capable of forming a plurality of openings being provided in the door in correspondence with the positions where the display units can be provided in the main body, and transparent protective means for covering at least one of the openings formed in the door. Thereby, one type of door can be applied to installation places requiring different numbers of display units. Thus, a reduction in parts cost can be achieved, stock control in the plant and shipping are facilitated, and the number of display units can be easily increased after installation.

What is claimed is:

1. A fire receiver for a building that is divided into sections for each of which window indication can be made by using a corresponding window, the fire receiver comprising:

a base having a frame for window indication;

a rectangular window sheet to which the names of the sections are written, said rectangular window sheet being fitted into the frame of said base; and a rectangular substantially transparent protective sheet, which is substantially of the same configuration as said rectangular window sheet, wherein said transparent protective sheet is arranged in front of said rectangular window sheet and has at its longitudinal ends engagement members to be engaged with engagement grooves of said frame and at its center a central engagement member to be engaged with a central engagement groove of said frame wherein said protective sheet is easily deformable to permit said protective sheet to be fitted in the frame.

2. A fire receiver according to claim 1, wherein said rectangular window sheet corresponds to a plurality of sections and includes a rectangular sheet longitudinally divided into a plurality of portions to which the names of the sections can be written.

3. A fire receiver according to claim 1, wherein indicating lamps are provided in correspondence with the sections.

4. A fire receiver comprising:

a main body in which a plurality of display units are provided;

a door mounted to said main body so as to be capable of opening and closing, said door having a plurality of openings corresponding to the positions where said display units can be provided in said main body;

transparent protective means mounted to said door and adapted to cover said plurality of openings; and opaque covering means attached to positions corresponding to said plurality of openings on said transparent protective means and separable from each opening.

5. A fire receiver according to claim 4, wherein said opaque covering means includes a plurality of opaque seals that are separable from said openings corresponding to the positions where said display units are actually provided in said main body.

6. A fire receiver according to claim 4, wherein said transparent protective means comprises at least one transparent protective plate, said one transparent protective plate collectively covers a plurality of said openings provided in a row in said door.

7. A fire receiver according to claim 4, wherein said opaque covering means is substantially the same color as said door.

8. A fire receiver according to claim 4, wherein said display units respectively make window indication using windows corresponding to sections into which a building is divided, and wherein said window includes a base having a frame for window indication and a rectangular window sheet to which the names of the sections are written and which is fitted into the frame of said base and a rectangular substantially transparent protective sheet which is substantially of the same configuration as said window sheet and is arranged in front of it and has at its longitudinal ends engagement members to be engaged with engagement grooves of said frame and at its center a central engagement member to be engaged with a central engagement groove of the frame.

9. A fire receiver comprising:

a main body in which a plurality of display units are provided;

a door mounted to said main body so as to be capable of opening and closing, a plurality of openings being formed in said door in correspondence with the positions where said display units can be provided in said main body; and protective means including a plurality of plates selected from a plurality of transparent protective plates and a plurality of opaque protective plates, said protective means being mounted to said door to cover said plurality of openings.

10. A fire receiver according to claim 9, wherein said opaque protective plates are substantially the same color as said door.

11. A fire receiver according to claim 9, wherein said display units respectively make window indication using windows corresponding to sections into which a building is divided, and wherein said window includes a base having a frame for window indication and a rectangular window sheet to which the names of the sections are written and which is fitted into the frame of said base and a rectangular substantially transparent protective sheet which is substantially of the same configuration as said window sheet and is arranged in front of it and has, at its longitudinal ends, engagement members to be engaged with engagement grooves of said frame and, at its center, a central engagement member to be engaged with a central engagement groove of the frame.

12. A fire receiver comprising:

a main body in which a plurality of display units are provided;

a door mounted to said main body so as to be capable of opening and closing, said door having a plurality of knock-out portions capable of forming a plurality of openings, wherein the knock-out portions are provided in said door in correspondence with the positions where said display units can be provided in said main body;

at least one opening formed in said door by removing at least one of the knock-out portions; and transparent protective means for covering said at least one opening in said door.

13. A fire receiver according to claim 12, wherein said display units respectively make window indication using windows corresponding to sections into which a building is divided, and wherein said window includes a base having a frame for window indication and a rectangular window sheet to which the names of the sections are written and which is fitted into a frame of said base, and a rectangular substantially transparent protective sheet which is substantially of the same configuration as said window sheet and is arranged in front of it and has, at its longitudinal ends, engagement members to be engaged with engagement grooves of said frame and, at its center, a central engagement member to be engaged with a central engagement groove of the frame.

* * * * *